US005289165A

United States Patent [19]

Belin

[11] Patent Number: 5,289,165

[45] Date of Patent: Feb. 22, 1994

[54] SMOKE ALARM APPARATUS

[76] Inventor: William B. Belin, c/o Doug Mason-Davin Realty 914 S. Dubuque, Iowa City, Iowa 52240

[21] Appl. No.: 858,037

[22] Filed: Mar. 26, 1992

[51] Int. Cl.[5] ..... G08B 17/10

[52] U.S. Cl. ..... 340/628; 340/693

[58] Field of Search ..... 340/628, 629, 630, 527, 340/528, 693, 632; 250/381, 382, 574, 573, 575; 356/437, 438

[56] References Cited

U.S. PATENT DOCUMENTS 4,236,822 12/1980 Jaretsky et al. ..... 340/628 X
4,785,293 11/1988 Shearer et al. ..... 340/628
4,788,530 11/1988 Bernier ..... 340/628 X
4,808,977 2/1989 Hedrick ..... 340/628 X

*Primary Examiner*—Jeffrey Hofsass
*Attorney, Agent, or Firm*—Leon Gilden

[57] ABSTRACT

A smoke alarm structure includes a first housing containing a sensor and audible alarm in electrical communication with a second housing. The second housing includes a back-up battery structure cooperative with a signal test button and a delay button in association to delay actuation of the audible alarm to permit audible alarms due to various signals such as cooking smoke and the like developed temporarily by individuals within a dwelling.

2 Claims, 4 Drawing Sheets

SMOKE ALARM APPARATUS

BACKGROUND OF THE INVENTION

1. Field of the Invention

The field of invention relates to smoke alarm apparatus, and more particularly pertains to a new and improved smoke alarm apparatus wherein the same is arranged to permit delay of an audible alarm relative to a smoke alarm structure.

2. Description of the Prior Art

The use of smoke alarms is notoriously well known, as well as their internal components. The use of electrical components are arranged to include various AC and DC back-up structure. The instant invention attempts to overcome deficiencies of the prior art by providing a second alarm housing mounting the test circuitry remotely relative to a first housing positioned adjacent a ceiling and the like permitting ease of access by individuals to the testing of various alarm equipment. The second housing is further arranged to include optional power level structure, as well as a delay button to permit selective delay of an audible alarm.

Various prior art smoke alarm structure is set forth and is exemplified by the U.S. Pat. Nos. 4,833,458; 4,870,395; 4,881,063; 4,679,037; and 4,525,703.

As such, it may be appreciated that there continues to be a need for a new and improved smoke alarm apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of smoke alarm apparatus now present in the prior art, the present invention provides a smoke alarm apparatus wherein the same is arranged in electrical communication with a remote housing to permit selective operation of the alarm structure remotely relative to a first housing of the organization. As such, the general purpose of the present invention, which will be described subsequently in greater detail, is to provide a new and improved smoke alarm apparatus which has all the advantages of the prior art smoke alarm apparatus and none of the disadvantages.

To attain this, the present invention provides a smoke alarm structure including a first housing containing a sensor and audible alarm in electrical communication with a second housing. The second housing includes a back-up battery structure cooperative with a signal test button and a delay button in association to delay actuation of the audible alarm to permit audible alarms due to various signals such as cooking smoke and the like developed temporarily by individuals within a dwelling.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved smoke alarm apparatus which has all the advantages of the prior art smoke alarm apparatus and none of the disadvantages.

It is another object of the present invention to provide a new and improved smoke alarm apparatus which may be easily and efficiently manufactured and marketed.

It is a further object of the present invention to provide a new and improved smoke alarm apparatus which is of a durable and reliable construction.

An even further object of the present invention is to provide a new and improved smoke alarm apparatus which is susceptible of a low cost of manufacture with regard to both materials and labor, and which accordingly is then susceptible of low prices of sale to the consuming public, thereby making such smoke alarm apparatus economically available to the buying public.

Still yet another object of the present invention is to provide a new and improved smoke alarm apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
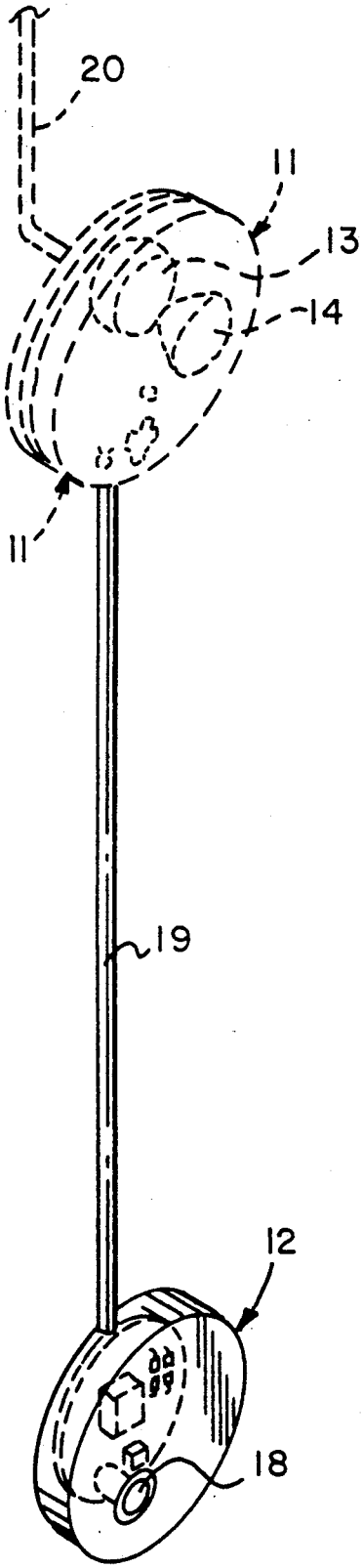
FIG. 1 is an isometric illustration of the invention.
Figure 2:
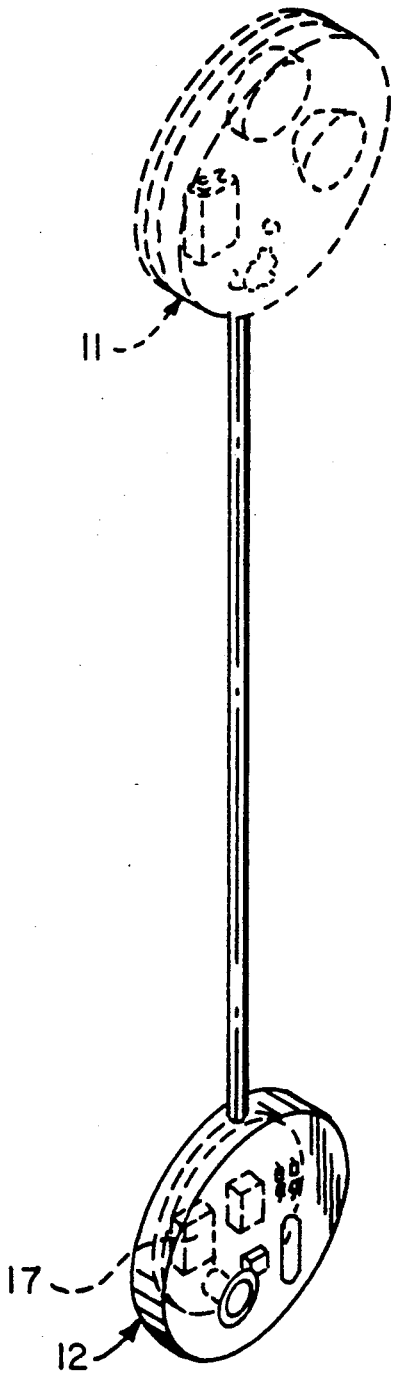
FIG. 2 is an isometric illustration of the invention utilizing a battery power supply.
Figure 3:
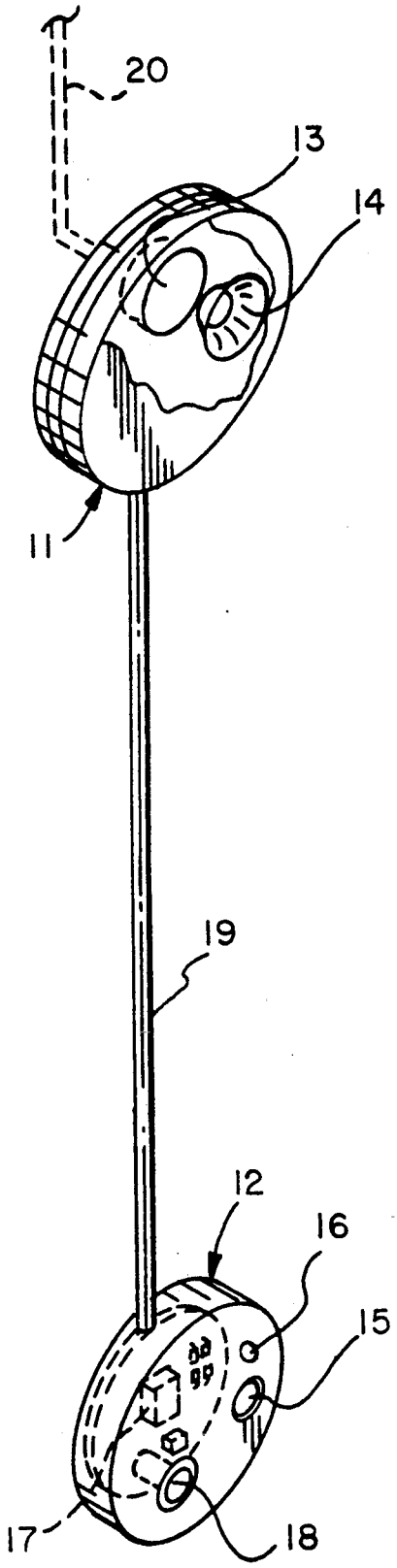
FIG. 3 is an isometric illustration of the invention in association with an indicator light.
Figure 4:
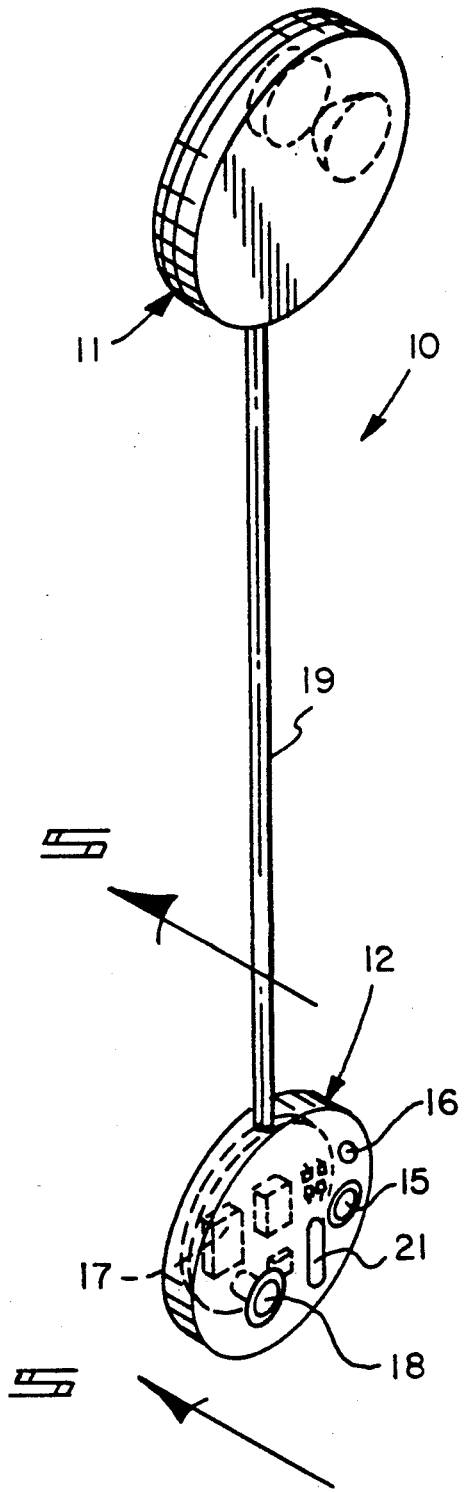
FIG. 4 is an isometric illustration of the invention in association with a circuit indicator light and a battery level meter.
Figure 5:
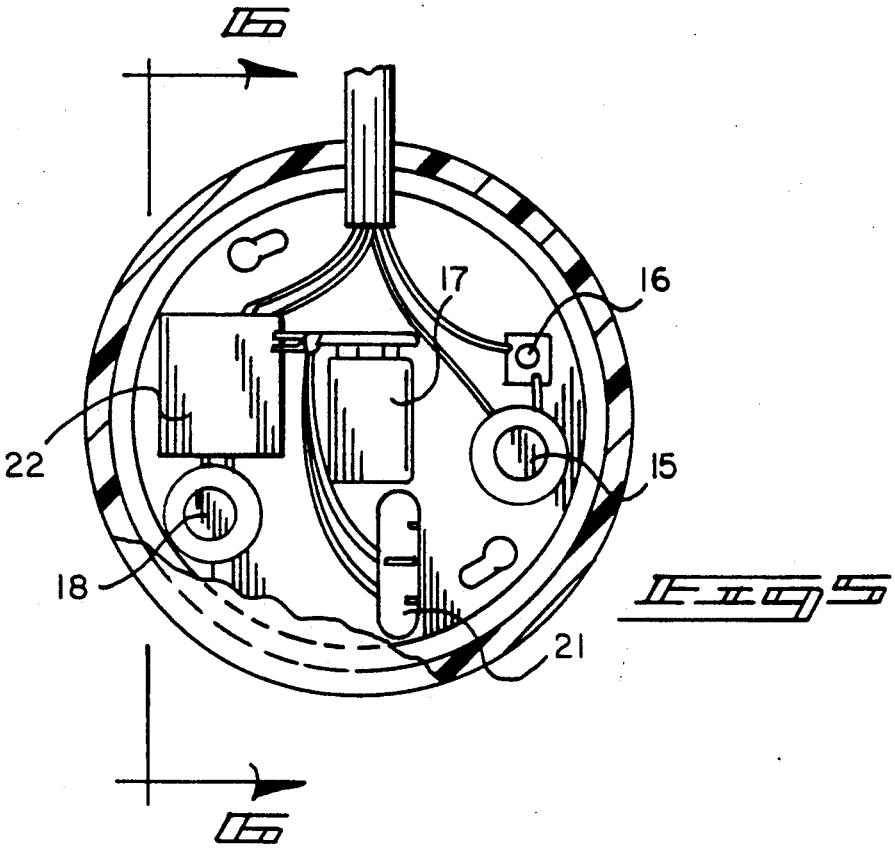
FIG. 5 is an orthographic view, taken along the lines 5—5 of FIG. 4 in the direction indicated by the arrows.
Figure 6:
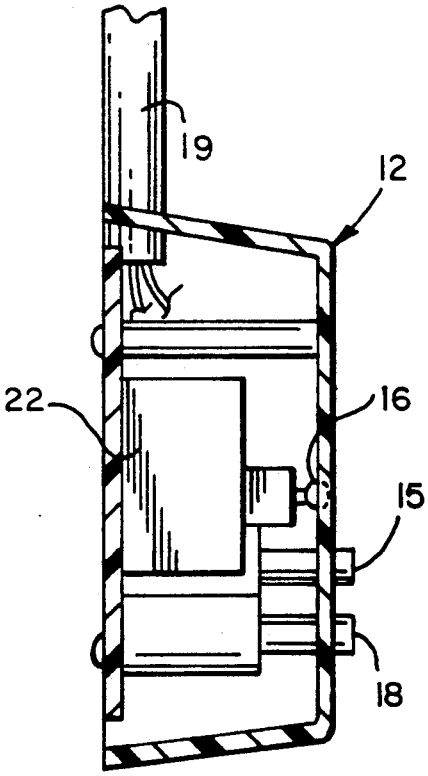
FIG. 6 is an orthographic view, taken along the lines 6—6 of FIG. 5 in the direction indicated by the arrows.

With reference now to the drawings, and in particular to FIGS. 1 to 7 thereof, a new and improved smoke alarm apparatus embodying the principles and concepts of the present invention and generally designated by the reference numeral 10 will be described.

More specifically, the smoke alarm apparatus 10 of the instant invention essentially comprises a first housing 11 separated from a second housing 12 by intermediate electrical connector conduit 19. The invention as illustrated in the relative FIGS. 1 and 2 sets forth the use of relative alternating current directed into the first housing by an electrical power supply 20, as opposed to a battery member supply 17 contained within the second housing 12.

The invention includes a smoke sensor member 13 in cooperation with an audible alarm 14. Such a first housing 11 by a typical fire code is positioned adjacent a ceiling or the like (not shown) within a dwelling. The smoke sensor member 13 is of conventional circuitry available in the prior art of types typified in U.S. Pat. Nos. 4,833,458 and 4,525,703, both patents incorporated herein by reference as examples of conventional smoke alarm detector apparatus.

The second housing 12 is arranged to include a signal test button 15 cooperative with the audible alarm 14 for proper indication of a circuit effectiveness of the organization, with the second housing 12 including a delay button 18 cooperative through a timer and delay circuitry housing 22 (see FIGS. 5 and 6) to effect delay of the audible alarm during actuation to prevent actuation of the audible alarm or its temporary disengagement during such conditions as fireplace smoke, cooking smoke, and the like being directed into a dwelling containing the smoke alarm structure to permit clearing of such transitory smoke. In this manner, individuals may prevent undesirable alarm signals from being directed from the audible alarm 14. Further, it should be noted that a circuit indicator light 16 utilizing typical LED type light members may be utilized to provide for visual indication of circuit availability. Further, the organization is arranged to include a battery charge indicator meter 21 of a typical analog scale, such as illustrated in the FIG. 5 for example, to indicate battery strength of the battery member 17.

Figure 7:
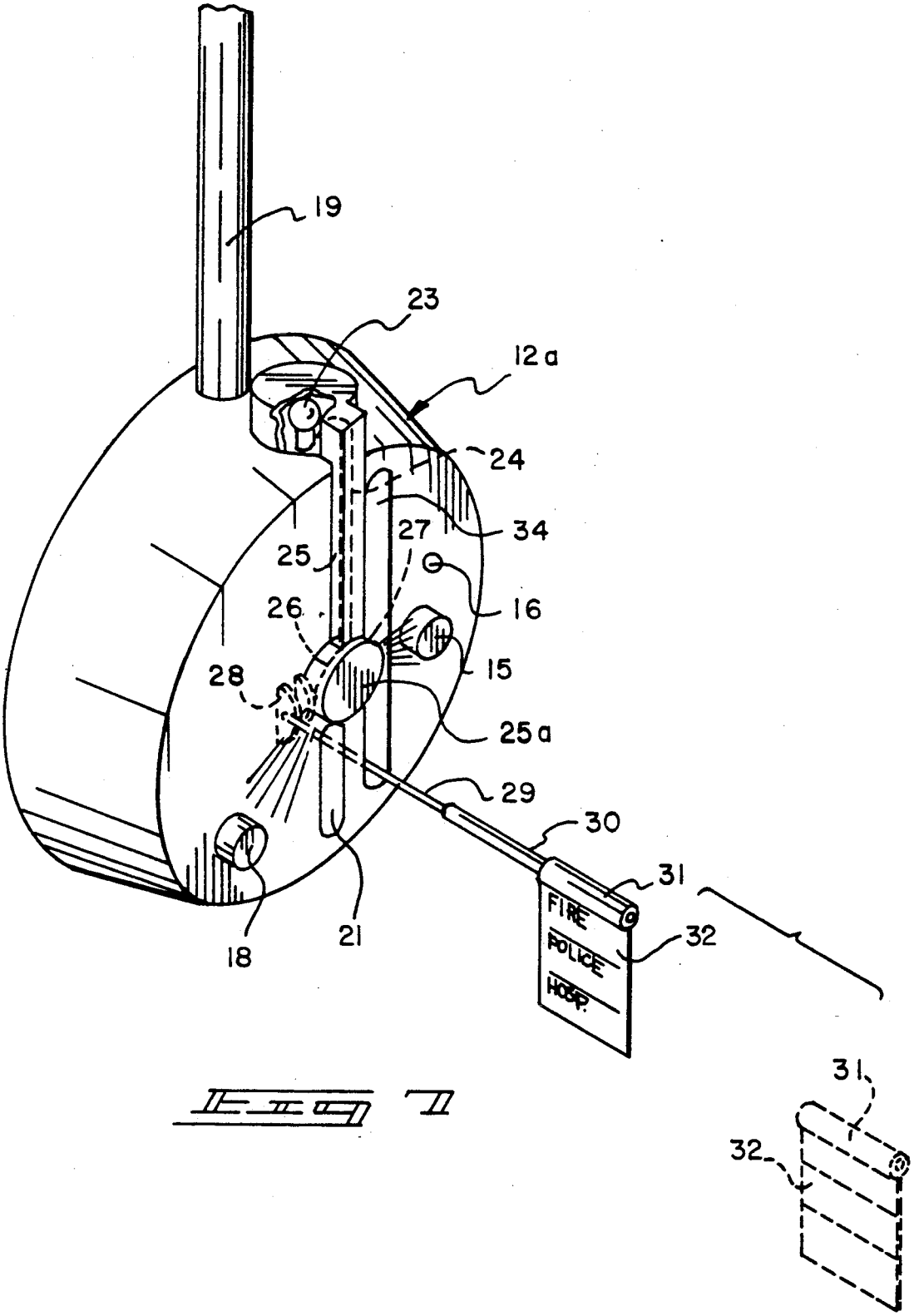
FIG. 7 is an isometric illustration of a modified second housing structure utilized by the invention.

The modified second housing 12*a*, as illustrated in the FIG. 7, is arranged to include an illumination bulb 23 arranged for continuous illumination in cooperation with a fiber optic cable 24 contained within a fiber optic cable housing 25 directed from the illumination bulb downwardly along a forward face of the lower housing 12*a*. The fiber optic cable housing 25 is directed into a fiber optic cable first branch 26 and a fiber optic cable second branch 27 within a lower fiber optic cable housing 25*a*. The first branch is directed to effect illumination of the delay button 18, with the second branch 27 oriented towards the test button 15 to provide for continuous positioning illumination of the second housing and its components for use of the organization in conditions of limited available light.

Further, a bifurcated support 28 is contained within the second housing 12*a* positioned rearwardly of a second housing slot 34 directed through the forward wall of the housing 12*a*. A first rod 29 is pivotally mounted at its rear distal end within the bifurcated support 28 and is telescopingly received within a second rod 30. The second rod 30 includes a second rod cylinder 31 slidably mounted relative to the free distal end of the second rod, with the second rod cylinder 31 containing a flexible note web 32 mounted to the second rod cylinder 31. The note web 32 contains various telephone numbers wherein an individual may remove the second rod cylinder 31 and the associated web 32 to take such information to a convenient to telephone various organizations such as a fire department. police department, a hospital, and the like. During periods of non-use, the second rod 30 is directed towards the bifurcated support 28 to receive the first rod 29 within the second rod and accordingly position the first rod 29 and the second rod 30 within the second housing slot 34. During periods of need, the second rod 30 is mounted downwardly relative to the slot 34 removing the second cylinder 31. The note web 32 is typically directed in a projecting orientation relative to the forward wall of the housing 12*a* from the second housing slot 34 for ease of grasping of the note web 32 during periods of use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A smoke alarm apparatus, comprising, a first housing, the first housing including a smoke sensor member, and an audible alarm contained within the first housing adjacent the smoke sensor member, and a second housing, the second housing spaced from and below the first housing, with an electrical connector conduit in electrical communication between the first housing and the second housing, and the second housing including a signal test button in cooperation with the smoke sensor member to effect selective actuation of the audible alarm, and a delay button, the second housing including a forward wall, with the delay button and the signal test button projecting through the forward wall, and a timer and delay circuit within a timer and delay circuit housing contained within the second housing in cooperation with the delay button to effect a timed delay of the audible alarm, and the second housing including an illumination housing bulb mounted to the second housing, with a fiber optic cable housing positioned adjacent the illumination bulb and directed along the forward wall, and a fiber optic cable, with a fiber optic cable rear distal end positioned adjacent the illumination bulb, and a fiber optic forward distal end, and a lower fiber optic cable housing mounted to the fiber optic cable housing, with the fiber optic cable forward end including a first fiber optic cable branch positioned adjacent the delay button, and a second fiber optic cable branch positioned adjacent the signal test button to provide for illumination of the signal test button and the delay button.

2. An apparatus as set forth in claim 1 with a bifurcated support contained within the second housing, and a second housing slot directed through the forward wall forwardly of the bifurcated support, and a first rod with the first rod including a first distal end pivotally mounted within the bifurcated support, and a first rod second distal end, and a second rod slidably and telescopingly receiving the first rod second distal end and the first rod therewithin, wherein the second rod includes a cylinder slidably mounted about the second rod, with the cylinder including a flexible note web mounted to the cylinder.

* * * * *